US007124675B1

(12) United States Patent
Sand

(10) Patent No.: US 7,124,675 B1
(45) Date of Patent: Oct. 24, 2006

(54) PORTABLE BALLISTIC SHIELD AND SHOOTING PLATFORM FOR POLICE AND MILITARY PERSONNEL

(76) Inventor: Michael A Sand, 8704 Towner Ave., Peyton, CO (US) 80831

( * ) Notice: Subject to any disclaimer, the term of this patent is extended or adjusted under 35 U.S.C. 154(b) by 76 days.

(21) Appl. No.: 10/963,959

(22) Filed: Oct. 14, 2004

(51) Int. Cl.
*F41H 5/08* (2006.01)

(52) U.S. Cl. ..... 89/36.07; 89/36.05; 109/49.5

(58) Field of Classification Search ..... 89/36.01, 89/36.05, 36.07, 36.09, 36.15; D29/100; 109/49.5
See application file for complete search history.

(56) References Cited

U.S. PATENT DOCUMENTS

| | | | | |
|---|---|---|---|---|
| 1,156,879 | A * | 10/1915 | Brown | 109/49.5 |
| 2,109,831 | A * | 3/1938 | Szalkay | 109/49.5 |
| 2,209,654 | A * | 7/1940 | Loeser, Jr. | 89/36.09 |
| 4,674,394 | A | 6/1987 | Martino | |
| 4,843,947 | A | 7/1989 | Bauer et al. | |
| 5,056,155 | A | 10/1991 | Truxell | |
| 5,293,807 | A * | 3/1994 | Hajdu | 89/36.07 |
| D359,820 | S | 6/1995 | Thumb et al. | |
| 5,641,934 | A | 6/1997 | Follett | |
| 5,862,882 | A * | 1/1999 | Brady et al. | 182/129 |
| 6,389,949 | B1 | 5/2002 | Carreira | |
| 6,595,101 | B1 | 7/2003 | Baker | |

* cited by examiner

*Primary Examiner*—Michael J. Carone
*Assistant Examiner*—Bret Hayes
(74) *Attorney, Agent, or Firm*—Theresa M. Seal

(57) ABSTRACT

A portable ballistic shield for use by civilian and military SWAT teams that provides both mobile and stationary cover, protection and a shooting platform for sniper and observer teams deployed behind the shield includes a rectangular-shaped planar member having a front surface that can include camouflage patterns, a rear surface and a lower edge having a rubber strip attached thereto for stabilizing the ballistic shield when disposed on the supporting surface. A centrally located gun slot is cut out adjacent the upper edge of the planar member and pivotally mounted to the rear surface is a pair of support legs for supporting the planar member. A slip-on camouflage cover is provided for covering at least the front surface so that the camouflage pattern can be adapted to suit the terrain and environment, such as urban, desert and midnight blue, where the shield is being deployed.

6 Claims, 4 Drawing Sheets

PORTABLE BALLISTIC SHIELD AND SHOOTING PLATFORM FOR POLICE AND MILITARY PERSONNEL

FIELD OF THE INVENTION

The present invention pertains to portable protective shields for use by police and military personnel, and more particularly pertains to a portable ballistic shield that can stand alone to provide protective cover for police and military snipers and SWAT teams to use as a shooting platform.

BACKGROUND OF THE INVENTION

Police and military SWAT teams rely on snipers and observers to provide continuous information, intelligence and cover fire before such teams approach or withdraw from the target location. Lacking the availability of adequate cover, observers and snipers must increase their distance from the target that negatively affects the accuracy of any shot that is taken. Such observers and snipers can use concealment such as Gilley suits and camouflage for more closely approaching the target; however, the use of such suits and camouflage brings with them the risk of injury or death by the user as such suits and camouflage do not provide for any type of bullet resistant protection. The current shields in use by individuals or teams require that personnel must position the gun through a port or hold the gun by hand around the side of the shield. These types of shields are for movement by the personnel such as approaching a building or door to close in on the target. Military and civilian personnel can stay behind such shields while holding the shields, but the individuals must manually hold the shields if they are stationary positioned. Such shields are primarily deployed for tactical movement.

As a result of the varied uses of shields, the prior art discloses a number of examples such as the Martino patent (U.S. Pat. No. 4,674,394) that discloses a portable bulletproof shield that includes a bulletproof shield having opposed sidewalls and a viewing lens assembly at the top of the shield.

The Bauer et al. patent (U.S. Pat. No. 4,843,947) discloses a riot shield having opposed vertical channel sections that permit the interlocking of one riot shield with an adjoining riot shield.

The Truxell patent (U.S. Pat. No. 5,056,155) discloses a buckler for use in melee fighting that includes a generally triangular-shaped upper segment and a tail-shaped lower segment.

The Thumb et al. patent (U.S. Des. Pat. No. 359,820) discloses a portable shield comprised of two interconnected trapezoidal portions with one of the portions including a pair of spaced-apart shoulder supports.

The Follett patent (U.S. Pat. No. 5,641,934) discloses a see-through bullet-resistant shield having at least one hand gripping strap and intended for vertical disposition.

The Carreira patent (U.S. Pat. No. 6,389,949 B1) discloses a shielding device that includes a core member and a plurality of spaced-apart cutouts that allows the individual to view objects and people while still utilizing the protection of the core member.

The Baker patent (U.S. Pat. No. 6,595,101 B2) discloses a ballistic shield that includes a central section and opposed side wing sections with a v-shaped upper cutout for supporting the barrel of a gun; however, the individual must use one hand to support the shield.

Nonetheless, despite the ingenuity of the above devices, there remains a need for a portable ballistic shield that provides both stationary and mobile protection for civilian and military SWAT teams from hostile fire and also provides a degree of camouflaged concealment for the users of the shield.

SUMMARY OF THE INVENTION

The present invention comprehends a self-supporting or stand alone portable ballistic shield that provides cover, concealment and protection for civilian police and military SWAT team members, such as snipers and observers, so that such members can more closely approach their target, observe and gather intelligence on the target, and be in a much better position to take a more accurate shot if such action is warranted. The portable ballistic shield can be quickly set up and broken down for providing sniper containment and observer protection, and cover for both, in various types of exposed terrains and environments.

The portable ballistic shield of the present invention includes a generally rectangular-shaped planar member having a front surface, an opposite rear surface, opposed side edges, an upper edge and a lower edge. Centrally located adjacent the upper edge is a gun slot that can accommodate both handguns and long guns. The front surface can include a camouflage pattern. A rubberized strip is placed on the lower edge for traction to prevent the shield from sliding and slipping when it is deployed on a supporting surface, especially a smooth supporting surface such as the hood or trunk of a vehicle. A pair of extendable and retractable support legs is pivotally mounted to the rear surface of the planar member for deploying the shield in a generally upright position on the particular supporting surface such as the ground or a street curb. For transporting and carrying the shield from site to site a plurality of handles and swivel rings are secured to the rear surface. In order to enhance the ability of the portable ballistic shield to cover, protect, and conceal personnel using it, one or more slip-on camouflage covers can be used with the shield, and each camouflage cover will have imprinted thereon a unique camouflage pattern such as midnight blue, urban camo, desert tan, etc. The appropriate slip-on camouflage cover can be placed on the planar member to at least cover the front surface with the camouflage pattern that blends in and is congruent with the terrain, area or environment that the shield is being deployed in.

It is an objective of the present invention to provide a portable ballistic shield that can be quickly deployed for providing protection to police and military personnel in an exposed area, terrain or environment.

It is another objective of the present invention to provide a portable ballistic shield that allows the sniper team to remain close to the target for insuring better intelligence gathering and a better, more accurate shot if needed.

It is yet another objective of the present invention to provide a portable ballistic shield that includes a variety of camouflage slip-on covers that can be placed over the shield for matching the terrain and providing concealment to the police or military personnel.

It is still yet another objective of the present invention to provide a portable ballistic shield that is self-supporting thereby freeing the hands and arms the snipers or SWAT team members.

It is still a further objective of the present invention to provide a portable ballistic shield that functions as a mobile protective shield behind which a sniper and/or observer team can safely deploy.

Still yet another objective of the present invention is to provide a portable ballistic shield usable as a mobile shooting platform for deployment in various environments such as urban street or flat terrain.

A further objective of the present invention is to provide a portable ballistic shield that can be used inside a police car for placement against the windows or the windshield so that the police car can be used as an armored vehicle during a civilian or police rescue.

A still further objective of the present invention is to provide a portable ballistic shield that includes at least one gun port for a handgun or a long gun while concealing and protecting the sniper or observer.

A still yet further objective of the present invention is to provide a portable ballistic shield that can be turned and rotated for accommodating either a right-hand or a left-hand shooter.

Still another objective of the present invention is to provide a portable ballistic shield that includes at least one non-slip lower edge that prevents the shield from sliding and slipping thus allowing the shield to be placed on the hood or trunk of a police vehicle thereby giving the civilian or police personnel more protection and a more stable platform to shoot from if necessary.

Another objective of the present invention is to provide a portable ballistic shield that can be placed on top of concrete walls or on curbs thereby giving the shooter more comfort, stability and accuracy if a shot needs to be taken whether the shooter is standing up or in a prone position.

Still a further objective of the present invention is to provide a portable ballistic shield for civilian and military personnel that functions as a stationary shield and shooting platform for a prone sniper and also functions as a mobile protective shield for personnel approaching the particular target.

These and other objects, features and advantages will become apparent to one skilled in the art upon a perusal of the following detailed description read in conjunction with the accompanying drawing figures.

DETAILED DESCRIPTION OF THE PREFERRED EMBODIMENT

Figure 1:
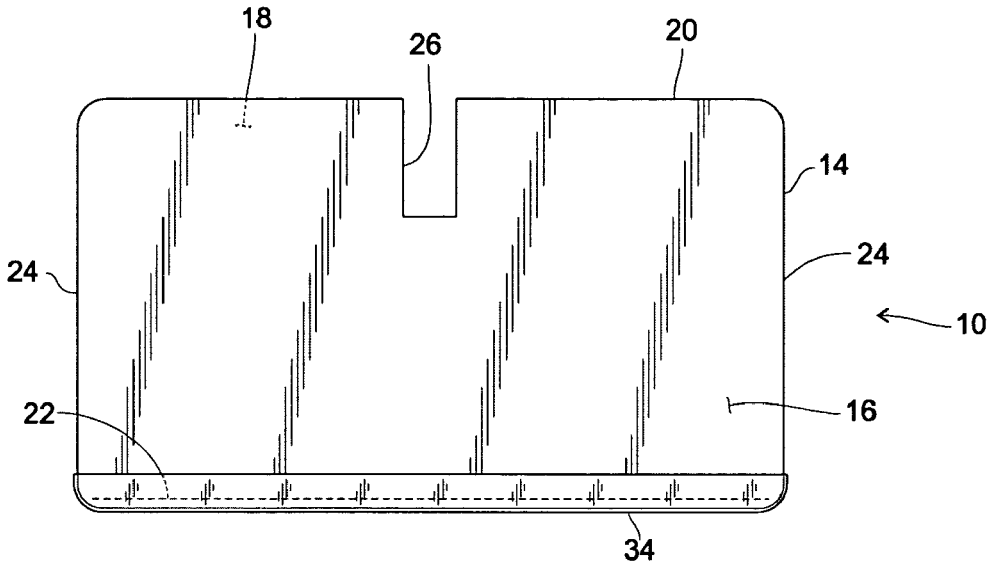
FIG. 1 is a front elevational view of the portable ballistic shield of the present invention.

Illustrated in FIGS. 1–8 is a sniper shield or portable ballistic shield 10 that provides and functions as a mobile bullet resistant shooting platform for civilian and military personnel 12 such as the snipers and observers that form part of the civilian and military police SWAT teams. The shield 10 can also be used as a mobile protective shield for protecting and covering the civilian and military personnel on approaching the target (the suspect) or withdrawing from the target. The portable ballistic shield 10 of the present invention enhances the gathering of accurate, up-to-date information and intelligence, and assists in closing the distance to the target that leads to more certainty in the identification of the target and greater accuracy of the shot if it has to be taken.

Thus, as shown in FIGS. 1–5, the portable ballistic shield 10 includes a generally rectangular-shaped planar member 14 composed of a bullet resistant material such as, for example, a combination of Kevlar r and fiberglass or Kevlar r, fiberglass and other composite materials that may include titanium and glass fibers or strands. The planar member 14 includes a front surface 16 and an opposite rear surface 18. The front surface 16 can have imprinted or impressed thereon one of a variety of camouflage patterns ranging from urban camo to desert tan to midnight blue. While the dimensions of the planar member 14 can vary, one preferred size is for the planar member 14 to be 42 inches across its long edge and 21 inches along its shorter edge.

More specifically, as shown in FIGS. 1–5, the planar member 14 includes an upper edge 20, a lower edge 22 and opposed side edges 24. Centrally located adjacent the upper edge 20 is a gun notch or slot 26 large enough for a helmeted sniper to sight a firearm through like the handgun 28 of FIG. 3 or the rifle 30 of FIG. 5. One preferred dimension for the gun slot 26 is three inches wide and eight inches deep. In order to stabilize the ballistic shield 10 when the shield 10 is deployed in the generally upright position on a supporting surface 32, which can include the ground, a curb or the hood or trunk of a vehicle, a flexible rubberized strip or member 34 is attachable to the lower edge 22 to provide traction and prevent the ballistic shield 10 from slipping and sliding thereon. The use of the rubberized strip 34 on the lower edge 22 provides the individual with a more stable shooting platform if a shot needs to be taken. The rubberized strip 34 tightly fits on the lower edge 22 but can be removed for cleaning and replacement.

Figure 3:
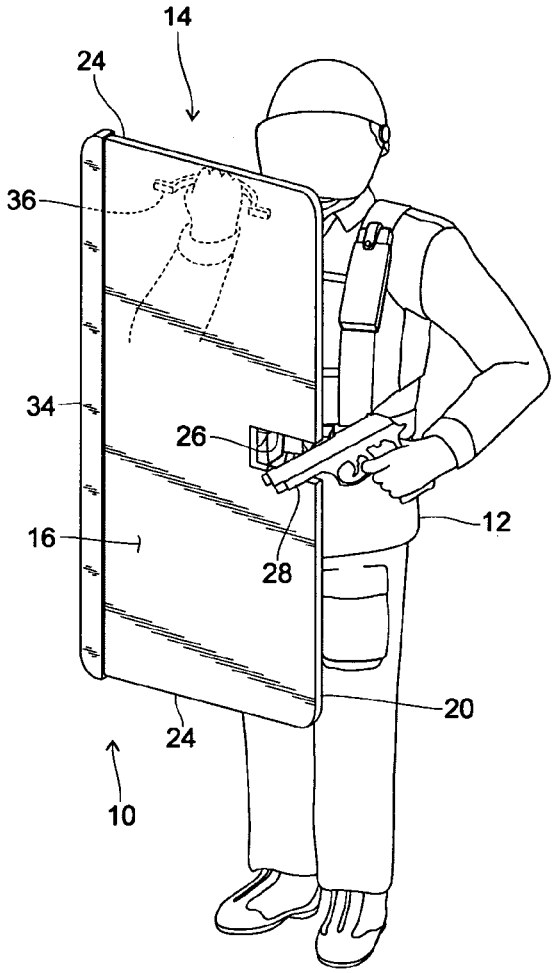
FIG. 3 is a perspective view of the portable ballistic shield of the present invention illustrating the vertical protective disposition of the shield for use by a left-handed shooter.
Figure 4:
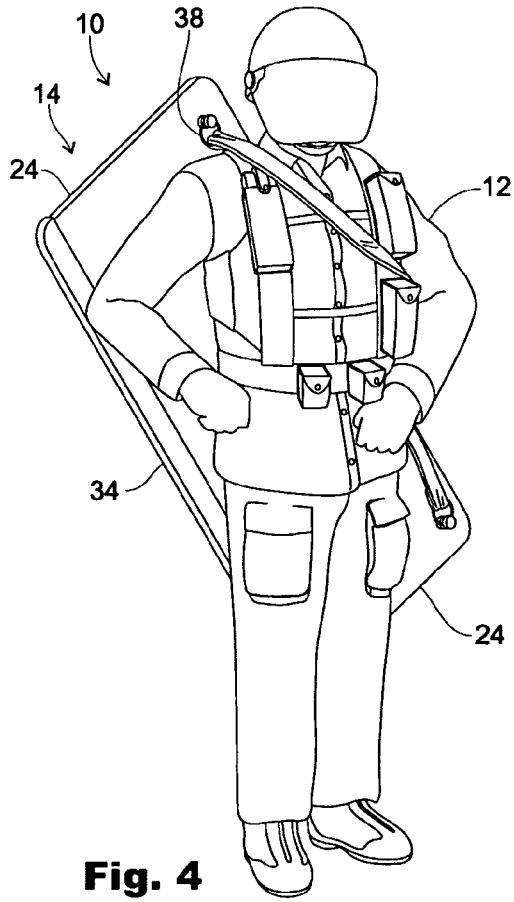
FIG. 4 is a perspective view of the portable ballistic shield of the present invention illustrating the use of the carrying strap for carrying the shield on the user's back.

As shown in FIGS. 3 and 4, the gear and clothing of the civilian and military personnel 12 often includes straps and tethers to which equipment can be attached for carrying and transport. Thus, the ballistic shield 10 includes a plurality of carry straps or handles 36 spaced about the rear surface 18 of the planar member 14 for attachment to straps, ropes, cords, or tethers of the equipment and clothing so that the ballistic shield 10 can be easily carried and transported by the individual. More importantly, when the ballistic shield 10 is used as a mobile shield for covering the individual on approaching the target, the individual can hold the shield 10 in his or her hands by grasping at least one of the carry handles 36 as particularly shown in FIG. 3. The individual's other hand is thus free to hold the handgun 28. In addition, a plurality of loops or swivel rings 38 are mounted to the rear surface 18 adjacent the corners of the planar member 14 for attachment to slings or straps that are part of the equipment and gear of the civilian and military personnel.

Figure 2:
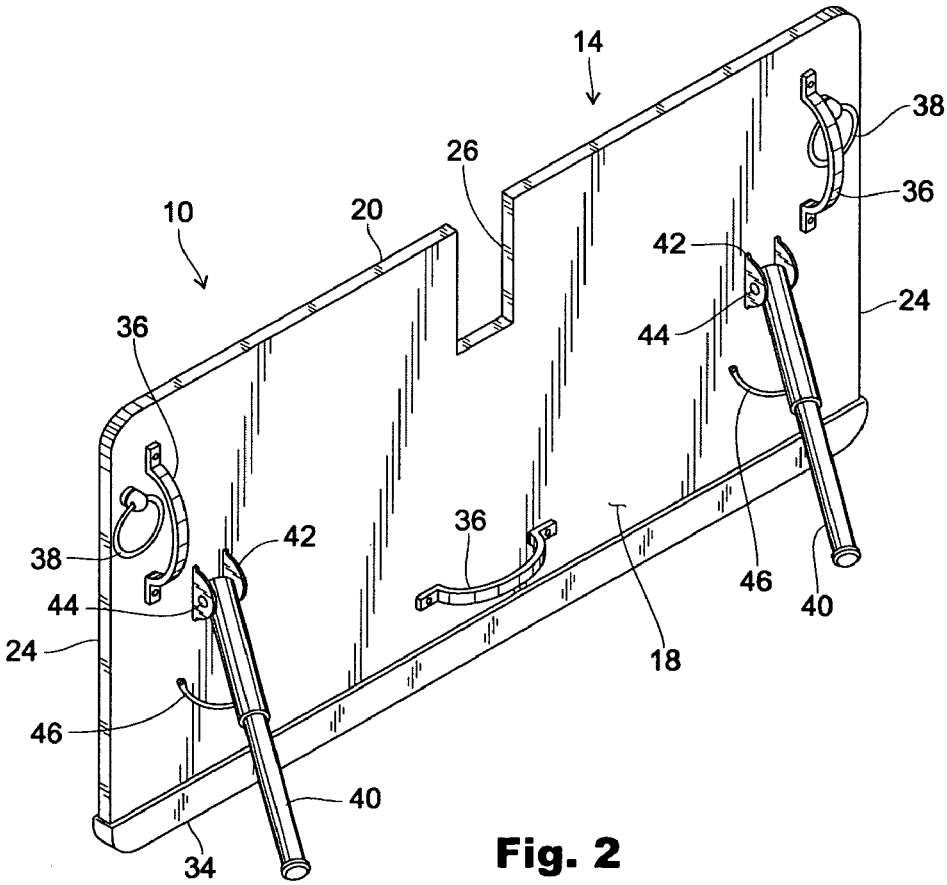
FIG. 2 is a perspective view of the portable ballistic shield of the present invention illustrating the deployment of the extendable support legs for supporting the shield in an upright disposition for use as a shooting platform.
Figure 5:
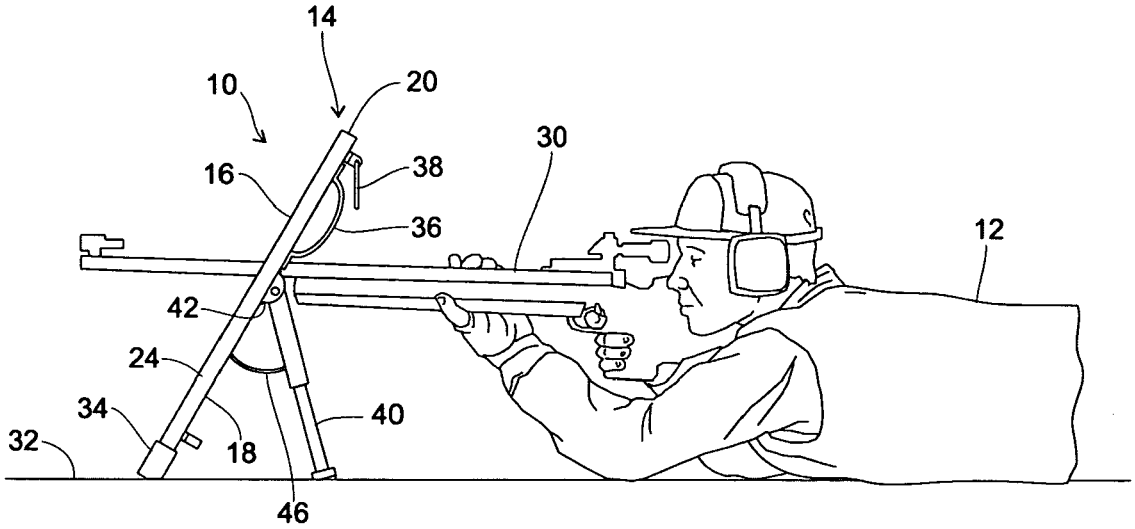
FIG. 5 is a side elevational view of the portable ballistic shield of the present invention illustrating the disposition of the shield for use by a prone sniper.
Figure 6:
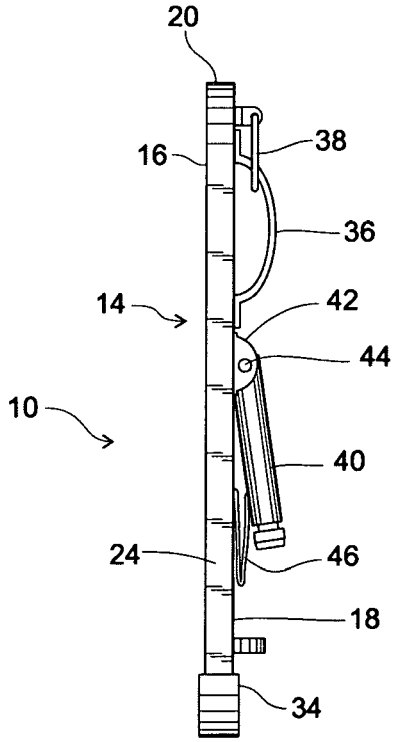
FIG. 6 is a side elevational view of the portable ballistic shield illustrating the retraction of the support legs for transport or storage.
Figure 7:
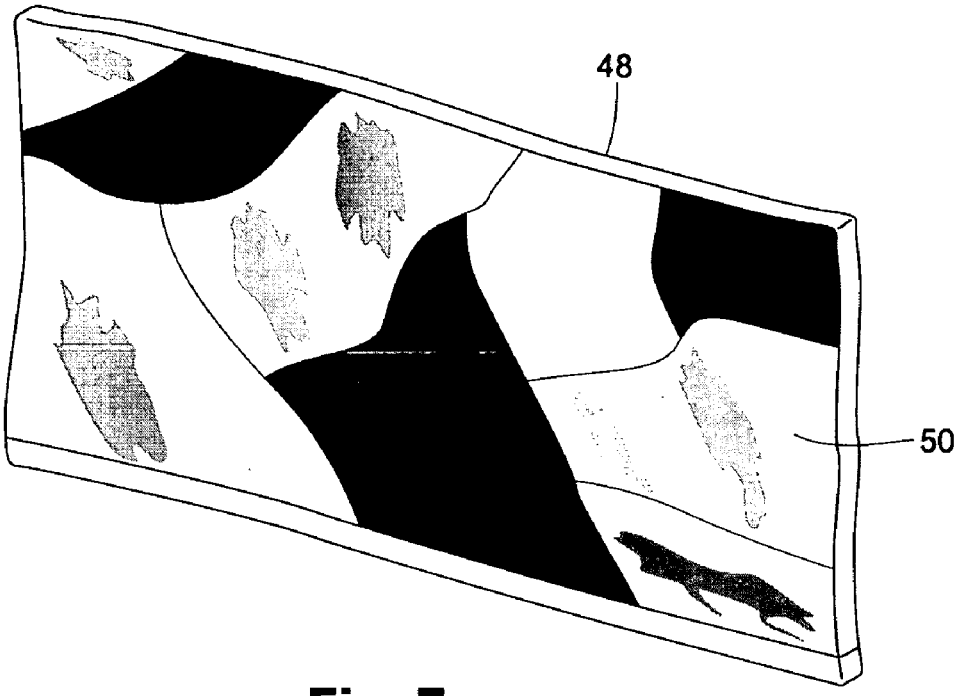
FIG. 7 is a perspective view of the slip-on elastic camouflage cover that can be placed over the portable ballistic shield for providing camouflage patterns simulating various types of terrains, backgrounds and environments.
Figure 8:
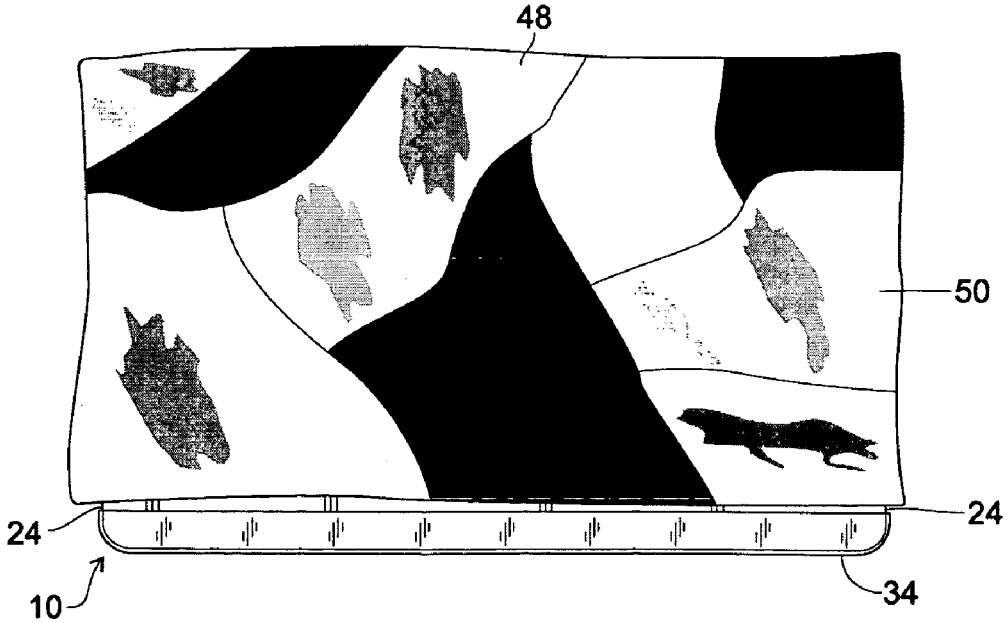
FIG. 8 is a front elevational view of the slip-on elastic camouflage cover placed on the planar member for covering the front surface of the planar member with a distinctive camouflage pattern.

In order to use the ballistic shield 10 as a stationary shield and shooting platform for the sniper team or observer to hide behind in a prone position, the ballistic shield 10 must be self-supporting, and thus includes a means to support the shield in a generally upright disposition as shown in FIG. 5. More specifically, as shown in FIGS. 2, 5 and 6, the means to support the planar member 10 includes a pair of extendible and retractable support legs 40 that are trunnion mounted to the rear surface 18 of the planar member 14. Each support leg 40 is secured to a bracket 42 by a pivot pin 44 on which the support leg 40 can rotate or pivot, and the pivotal motion of the support legs 44 is constrained by a tether 46 that has one end connected to the support leg 40 and the opposite end connected to the rear surface 18 of the planar member 14. The tethers 46 limit the range of motion of the support legs 40 so that the support legs 40 do not interfere with the deployment of the ballistic shield 10 when the ballistic shield 10 is used as a mobile shield and also when the ballistic shield 10 is being transported and carried by the individual 12.

Because the portable ballistic shield 10 will be used in a variety of locations, environments and terrains, adapting the shield 10 to the surrounding terrain and lighting conditions by including the appropriate matching camouflage color and pattern on the front surface 16 of the shield 10 helps the shield 10 to blend into the terrain and environment making the shield 10 less noticeable to the target. Thus, the portable ballistic shield 10 also includes a slip-on elastic camouflage cover 48 that can be placed on the planar member 14 for covering at least the front surface 16 with a particular camouflage pattern 50 for matching the shield 10 to the terrain and environment where the ballistic shield 10 is being deployed. More than one camouflage cover 48 can be interchangeably used with the shield 10, with each camouflage cover 48 having a different camo pattern imprinted thereon. Camouflage patterns can include, for example, woodland, urban camo, grey, desert tan, and midnight blue.

In using the portable ballistic shield 10 the SWAT team would tactically approach the desired location and target with cover fire available. At the desired location the shield 10 would be dropped to the supporting surface 32, such as the ground or street curb, with the support legs 40 extended for contacting the ground 32 to support the shield 10 as shown in FIG. 5. The support legs 40 would be extended for reclining the shield 10 to a comfortable shooting position. It should be noted that the camouflage cover 48 would be placed on the shield 10 prior to deployment for matching the shield 10 to the terrain and surroundings for concealing the SWAT team personnel 12 from the target. By closing the range to the target the SWAT team sniper has a better view of the target and obtains a more accurate shot if the need arises.

The ballistic shield 10 is adaptable to a variety of situations for use as a stationary protective shield and shooting platform as well as a mobile protective shield for approaching and closing with the target or suspect. By using the carry handles 36 the ballistic shield 10 can be used as a mobile protective and defensive shield for cover on approaching the target. The gun slot 26 would be used as a gun port for the handgun 28, as shown in FIG. 3, during the approach to the target. The shield 10 can be rotated—either 90 or 180 degrees—to accommodate either a right-handed shooter or a left-handed shooter. In addition, the ballistic shield 10 is adaptable for placement on the hood or trunk of a vehicle, such as a police car, with the slip resistant rubberized strip 34 resting on the hood or trunk of the vehicle for providing civilian and military personnel with more protection and a more stable platform from which to shoot if the need arises. Moreover, the ballistic shield 10 can be placed or leaned against the inside window or windshield of the vehicle for protection should the vehicle be used as a rescue vehicle. Also, the shield 10 can be positioned on top of a concrete wall to protect the shooter and to allow the shooter to stand up. This use of the shield 10 provides the shooter with more comfort, stability, and more accuracy if a shot needs to be taken.

The foregoing should be considered as only illustrative of the principles of the invention, and since numerous modifications, alterations, and variations are both possible and practicable to those skilled in the art, it is not desired to limit the invention to the exact construction and operation shown and described, and accordingly, all suitable modifications may be resorted to while falling within the scope of the invention and the appended claims.

I claim:

1. A portable ballistic shield for disposition on a ground surface for providing protection and concealment to stationary and mobile civilian and military personnel, comprising:

a generally rectangular-shaped planar member composed of a bullet resistant material;

the planar member having a front surface, an opposite rear surface, a pair of opposed side edges, an upper edge and a lower edge;

a gun slot centrally located adjacent the upper edge of the planar member through which a barrel of a firearm can be projected;

a pair of spaced-apart brackets located on the rear surface of the planar member;

a pair of selectively and independently extendable and retractable support legs with each support leg having an attachment end for pivotal mounting to each bracket and an opposite lower end for contacting the ground surface;

a pair of tethers with each tether having one end attached to the lower end of one of the pair of support legs and an opposite end secured to the rear surface of the planar member so that the tethers delimit the range of pivotal motion of the support legs; and whereupon placement of the planar member on the ground surface and the concomitant selective and independent extension and pivoting of the support legs within the range of pivotal motion as delimited by their respective tethers and the contacting of the lower ends of the support legs with the ground surface allows for the inclined disposition of the planar member on the ground surface for attaining a comfortable shooting position and for protecting and concealing civilian and military personnel.

2. The portable ballistic shield of claim 1 further comprising a plurality of interchangeable slip-on camouflage covers with each camouflage cover placeable on the planar member for covering at least the front surface of the planar member.

3. The portable ballistic shield of claim 2 wherein at least one of the plurality of camouflage covers includes a woodland camouflage pattern imprinted thereon.

4. The portable ballistic shield of claim 3 wherein at least one of the plurality of camouflage covers includes an urban camouflage pattern imprinted thereon.

5. The portable ballistic shield of claim 4 wherein at least one of the plurality of camouflage covers includes a desert tan camouflage pattern imprinted thereon.

6. The portable ballistic shield of claim 5 wherein at least one of the plurality of camouflage covers includes a midnight blue camouflage pattern imprinted thereon.

* * * * *